United States Patent [19]

Gruner

[11] 3,946,185

[45] Mar. 23, 1976

[54] SPRING WIRE CONTACT ASSEMBLY

[75] Inventor: George Gruner, San Jose, Calif.

[73] Assignee: Intersil, Inc., Cupertino, Calif.

[22] Filed: Aug. 21, 1974

[21] Appl. No.: 499,323

[52] U.S. Cl. ..... 200/245; 200/165

[51] Int. Cl.[2] ..... H01H 1/24

[58] Field of Search..... 200/276, 245, 246, 159 R, 200/159 A, DIG. 2, 165, 327

[56] References Cited

UNITED STATES PATENTS

| | | | |
|---|---|---|---|
| 2,835,754 | 5/1958 | Lewis | 200/276 |
| 3,227,822 | 1/1966 | Corey | 200/302 X |
| 3,244,847 | 4/1966 | Erpel | 200/276 X |
| 3,384,727 | 5/1968 | Zavertnik et al. | 200/302 X |
| 3,430,019 | 2/1969 | Krautwald et al. | 200/245 |
| 3,433,914 | 3/1969 | Ericsson | 200/159 A |
| 3,860,776 | 1/1975 | Lockard | 200/276 |

*Primary Examiner*—Robert K. Schaefer
*Assistant Examiner*—William J. Smith
*Attorney, Agent, or Firm*—Gregg, Hendricson, Caplan & Becker

[57] ABSTRACT

A subminiature switch structure particularly adapted for cooperation with integrated circuits as may, for example, be employed in an electronic watch including a restrained spring wire manually movable by resilient bending from normal spring loaded engagement with a first terminal into wiping engagement with a second terminal.

8 Claims, 6 Drawing Figures

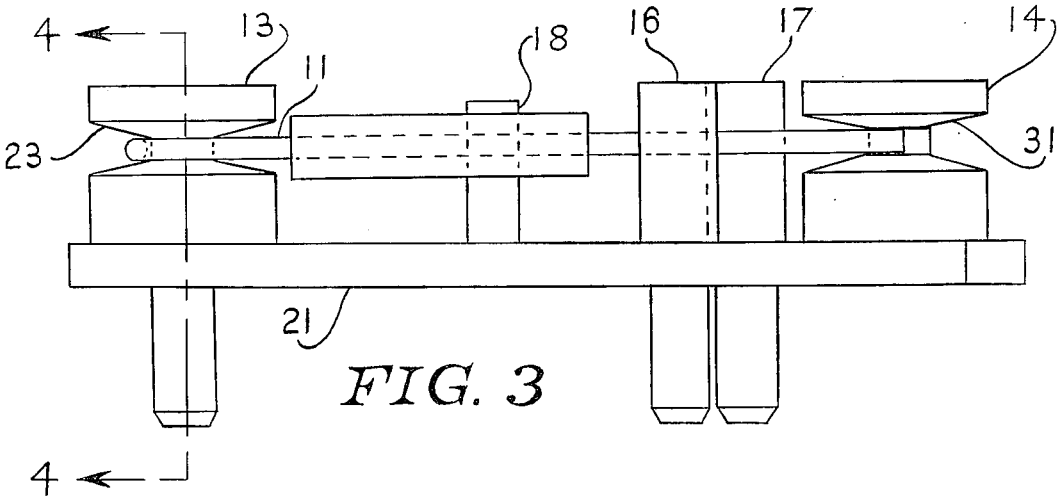
FIG. 3
FIG. 4
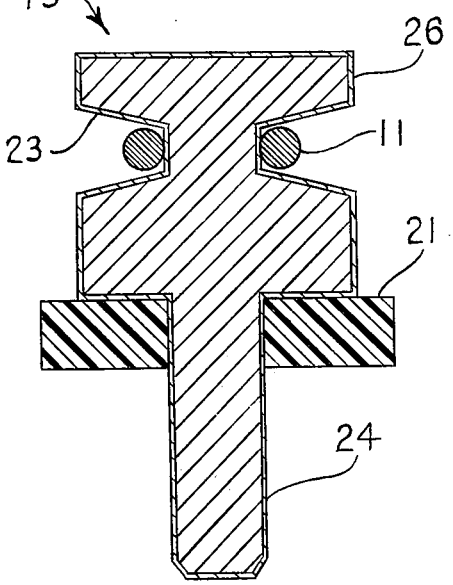
FIG. 5
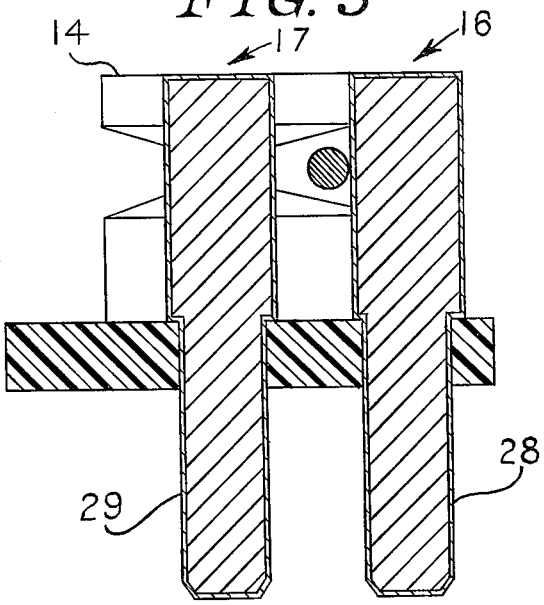
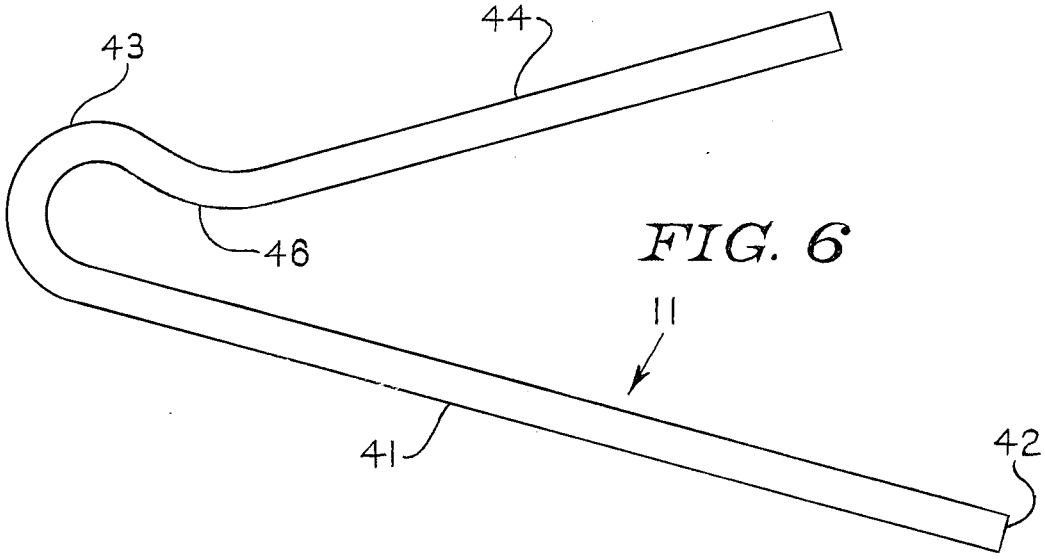
FIG. 6

SPRING WIRE CONTACT ASSEMBLY

BACKGROUND OF INVENTION

Various applications of integrated circuits such as, for example, in the field of electronic watches required incorporation of manually operable switches. In order to obtain the benefit of the size reduction afforded by integrated circuits, it is necessary to employ very small switches of this type and this causes various mechanical difficulties. It is recognized that an integrated circuit having a dimension, for example, of a fraction of an inch square may incorporate a very large number of elements and functions and yet hybrid devices that may be necessarily employed therewith are much larger than the circuit itself and perform but a single function. As an example, certain types of electronic watches have a digital display which may employ light emitting diodes, for example, which are energized to become visible for reading the time by manual operation of an actuator or button extending from the watch case. It has been conventional to provide single pole, single throw switches for this purpose even though the circuitry benefits from the incorporation of a single pole, double throw switch. Difficulties have also arisen in connection with the reliability of very small mechanical switches employed for purposes such as that set forth above.

The present invention provides a subminiature mechanically actuated switch having highly improved reliability from both the mechanical and electrical standpoints.

SUMMARY OF INVENTION

The electronic switch of the present invention, which is particularly adapted for utilization with integrated circuits, such as those employed in electronic watches, incorporates a fine spring wire which is wrapped in part about a first terminal and extends into engagement with a captive post. The wire has an otherwise free end restrained in order to resiliently urge the wire adjacent the opposite end into engagement with a second terminal. A third terminal is provided in close proximity to the wire adjacent the captive post and on the opposite side of the wire from the second terminal so that application of pressure to the wire between the first and second terminals will resiliently deflect the wire into engagement with the third terminal. As the wire is moved into engagement with the third terminal there occurs a wiping action for cleaning electrically contacting surfaces therebetween.

Provision is made herein for retaining the resiliently deformed wire about the first terminal of the switch by disposing the wire in a groove about such terminal and furthermore by initially deforming the wire or kinking the wire at the first terminal so that the wire cannot become disengaged from the first terminal. A first end of the wire of the present switch extends from the first terminal alongside and in engagement with the second terminal and terminates at a groove or depression in a captive post. A second end of the wire on the other side of the first terminal is bent back toward the first end to thus resiliently deflect the spring wire and the wire is held in such deflected position by restraining means so that the switch provides electrical connection between the first and second terminals in normal unoperated or unactuated condition. The switch may include an insulator about the spring wire between the first terminal and captive post and also the switch may include an insulated base plate upon which there are mounted the various terminals and posts of the switch.

In order to achieve maximum electrical conductivity between terminal and switching elements of the present invention, it is provided that the spring wire shall preferably be formed as a steel wire and for subminiaturization this is comprised as a steel music wire. The terminals or terminal posts of the switch hereof are preferably formed of brass with a rhodium plating. The extremely small size of the present invention requires only very small sized terminals which consequently require but an extremely small amount of plating so that the cost of rhodium plating is not a disadvantage hereof.

The present invention is preferably formed as an extremely small switch which may, for example, have a length less than one-half inch and a width less than two-fifths of an inch.

DESCRIPTION OF FIGURES

The present invention is illustrated in the accompanying drawings wherein:

FIG. 3 is a side elevational view of the switch of FIG. 2;

FIG. 4 is a vertical sectional view taken in the plane 4—4 of FIG. 3;

FIG. 5 is a vertical sectional view taken in the plane 5—5 of FIG. 2; and FIG. 6 is a plan view of the wire of the switch hereof before assembly in the switch.

DESCRIPTION OF PREFERRED EMBODIMENT

Figure 1:
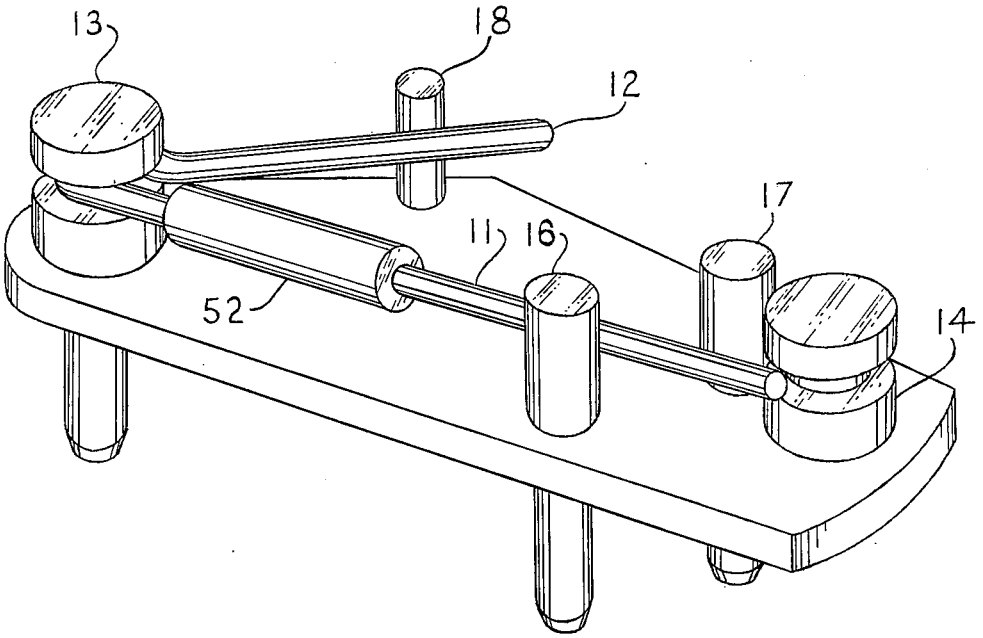
FIG. 1 is a perspective view of a switch formed in accordance with the present invention.

A preferred embodiment of the present invention, as illustrated in FIG. 1 of the drawings, includes as a major component thereof a short length of spring steel wire 11 of the grade music wire. This wire 11 comprises the movable contacts of the present invention and the spring loaded force providing the double throw function of the invention. The wire 11 extends from a first end 12 thereof about a first terminal 13 into engagement with a captive post 14. Second and third terminals 16 and 17 comprised as posts are disposed on opposite sides of the wire 11 between the first terminal 13 and captive post 14. The wire 11 extends in substantially a straight line between the first terminal 13 and captive post 14 and bears against the terminal post 16. The spring wire 11 is compressed to be urged outwardly against the second terminal post 16 by deflecting the wire end 12 inwardly toward the wire end 14 and the wire may be maintained in this deflected position by an upright or restraining post 18. In this condition the wire 11 is constrained to bear against the second terminal post 16 while being wound partially about the first terminal post 13. Application of an inward force upon the wire 11 between the first terminal post 13 and captive post 14 will deflect the wire and move it away from terminal 16 and into engagement with terminal 17. The switch will thus be seen to provide for controlled connection between the first terminal 13 and either of the terminals 16 and 17.

Considering now a preferred structure of the present invention in somewhat greater detail and referring to FIGS. 2 to 5, it will be seen that the posts of the present invention are preferably mounted upon an insulated base 21. The restraining post 18 may be integrally formed with the base. The first terminal post 13 is formed as a metallic cylinder having a peripheral groove 23 within which the wire 11 is wrapped partially about the post and includes a depending portion 24 extending through the insulating base 21. Preferably the terminal post 13 is formed of brass having a rhodium plating 26 thereon. Although other metals or combinations of metals may be employed for the terminals, it has been found that superior electrical contact is obtained between the steel wire and a post formed of rhodium plated brass.

The second and third terminal posts 16 and 17 may be identically formed as cylinder with each having a reduced cross section portion extending through the insulating base 21 to depend therefrom. The terminal posts 16 and 17 are also preferably formed of rhodium plated brass. All of the terminals are securely mounted upon the base 21 as by cementing the terminals thereto. The depending portions 28 and 29 of terminal posts 16 and 17 respectively are preferably formed of the same size as the depending protion 24 of terminal post 13 so that all of these depending portions comprise prongs or male elements of the connector for pluging the switch into a printed circuit board, for example.

The captive post 14 may be formed the same as the first terminal post 13 and includes a peripheral groove 31 in which an end of the wire 11 rests. In the illustrated embodiment of the present invention, the captive post serves only as a retainer or restraining means for an end of the wire 11 however, it is possible for this post to be employed as a terminal if desired. Also it is noted that the captive post may include a depending portion extending through the base much in the manner of the structure of the first terminal post 13 if desired. By disposing the wire end in the groove 31 the wire is prevented from vertical movement.

The first terminal post 13 and captive post 14 are disposed in spaced relation on the base 21 with the second and third terminal 16 and 17 disposed on opposite sides of the wire 11 between these elements and adjacent post 14. The wire 21 preferably comprises a fine resilient steel wire such as music wire which has been permanently deformed as illustrated in FIG. 6. The wire may be considered as a first straight leg or portion 41 extending from a first end 42 to a generally U-shaped bend 43 and a second straight leg 44 extending at an angle to the first leg. The joinder of the second leg 44 and U-shaped bend 43 is comprised as a reverse bend 46 as related to the direction of curvature of the U-shaped bend 43. The wire illustrated in FIG. 6 will thus be seen to somewhat resemble a hair pin with one leg being kinked outwardly at the top thereof.

Figure 2:
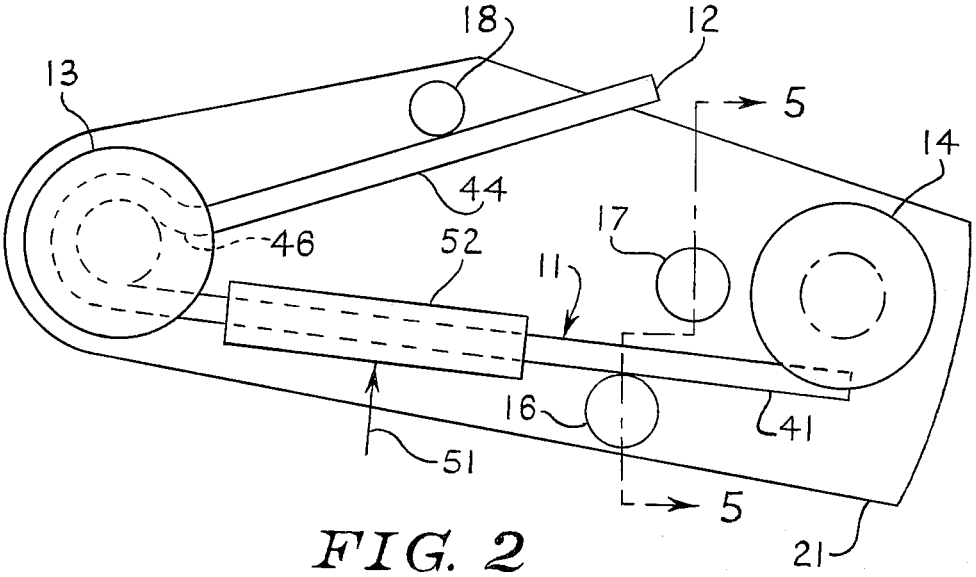
FIG. 2 is a plan view of the switch of FIG. 1.

The wire 11 is placed on the switch by slipping the U-shaped bend 43 into the groove 23 in the first terminal post 13 with the first leg of the wire extending along the front of the switch between the terminal posts 16 and 17. The second or rear leg 44 of the wire is then resiliently sprung over the restraining post 18 to urge the U-shaped bend more tightly about the terminal post 13 and swing the sharp bend 46 of the wire toward the first leg 41 so that the separation therebetween is less than the diameter of the post 13 at the groove 23 thereabout. This is clearly shown in FIG. 2 and will be seen to firmly lock the wire on the post 13. Placement of the wire about the post, as described above, resiliently urges the first leg 41 of the wire toward the front of the switch into firm engagement with the second terminal post 16. The posts 13 and 14 are disposed generally in alignment so that the end 42 of the wire at the captive post remains in the groove 31 thereabout but actually out of engagement with the interior of the post at the groove. This also is illustrated in FIG. 2. In the position illustrated in FIG. 2 the switch of the present invention provides electrical connection between terminal post 13 and terminal post 16. This is the normal unactuated position of the switch.

Actuation of the switch of the present invention is accomplished by applying a force to the front or first leg 41 of the wire 11 in a direction generally toward the second leg of the wire. This is indicated by the arrow 51 of FIG. 2 and an insulator 52 may be formed about the wire in this area. Application of an inward force as indicated by the arrow 51, resiliently deflects the wire 11 to move the first or front leg 41 thereof inwardly of the switch into engagement with the third terminal 17 and out of engagement with the second terminal 16. The switch itself does not provide a fixed stop to terminate movement of the switch arm comprised of the wire 11 but instead relies upon the resiliency of the wire to apply a return force and also contemplates the force applying means as having a mechanical limitation upon the distance over which the force may be applied. As the wire engages the terminal 17 there occurs a minute wiping action, i.e. lateral motion of the wire with respect to the terminal and this is highly advantageous in maintaining a clean electrical contact. Release of the force applied to the wire will cause the wire to resiliently move back into the position illustrated in FIG. 2 wherein the wire engages the second terminal 16 rather than the third terminal 17.

It has been noted above that the present switch is very small and in fact a switch formed in accordance with the present invention for utilization in an electronic watch had a total length of 0.403 inch and a maximum width of 0.14 inch. The music wire employed as a switch element had a diameter of the order of 1/64 inch. The separation between the wire and the third terminal 17 in the normal switch position was of the order of 0.005 inch. This switch was operated for more than 1,2500,000 cycles without signs of wear of failure.

It is noted that the present invention is particularly adapted to utilization in an electronic watch, for example, wherein the switch is to be manually operated. Preferably, the actuator or operator employed to apply the force to the spring of the switch has its own mechanical stop so that it can only be depressed a limited distance. Such a conventional actuator or pushbutton would normally be mounted on the case of the watch and total button or actuator movement upon depression thereof might be of the order of 0.025 inch. Because of the extremely minute nature of elements employed in an electronic watch, for example, the engagement of a mechanical actuator such as noted above with elements of the watch might easily cause physical damage. The foregoing occurs by virtue of the fact that there are substantially unavoidable tolerances in manufacture of parts and in the area of the switch actuator such tolerances may well result in variations in location or placement of elements by $\pm$ 0.012 inch. With the present invention, these tolerances do not pose a problem, for if the switch arm is physically located somewhat closer to the actuator than intended, full movement of the actuator will only resiliently deflect the switch arm further rather than apply a substantial force to some element of the switch which might then cause mechanical damage to either the switch or a printed circuit or the like upon which the switch may be mounted. Stated in another way, the present switch allows over travel, i.e. movement of a switch arm beyond the contact position without damage to the switch structure. The above noted wiping action of the switch arm upon the terminal may comprise but a very minute movement such as 0.0005 inch, however, this is sufficient to clean the contacts for insuring good electrical connection upon each switch actuation.

In use of the present invention in an electronic watch, for example, the terminal 17 might be connected to plus battery and the terminal 16 to minus battery with the terminal 13 then connected to the integrated circuit of the watch. It will be seen that by the present provision of a single throw double pole switch the circuit may then be connected to either plus or minus battery while conventional single pole single throw switches employed in electronic watches do not provide this capability. Without attempting to further describe electronic watches it is noted that the capabilities of the present invention are highly advantageous in connection with circuitry employed therein.

Although the present invention has been described above in connection with a single preferred embodiment thereof it is not intended to limit the invention to the precise details of illustration or exact terms of description for it will be apparent to those skilled in the art that variations in the invention may be made within the scope of the present invention.

What is claimed is:

1. An electronic switch comprising:

a first terminal post, second and third terminal posts spaced from said first post and closely separated from each other, a spring wire extending between said second and third terminal posts and wrapped partially about said first terminal post, means disposed on the opposite side of said second and third terminal posts from said first terminal post engaging said wire and limiting lateral movement of said wire thereat, said wire being adapted for deflection to normally resiliently hold same against said second terminal post and further deflection by the application of an operating force between said first terminal post and said second and third terminal posts to deflect the wire out of contact with the second terminal post and into contact with the third terminal post.

2. The switch of claim 1 further defined by an insulating base mounting said terminal posts and having a restraining post spaced from said terminal posts with an end of said wire bearing thereon to resiliently deflect said wire and hold the wire resiliently about said first terminal post and normally against said second terminal post.

3. The switch of claim 1 further defined by said means restraining said wire from movement longitudinally of said terminal posts.

4. The switch of claim 3 further defined by said means restraining the wire including a captive post having a peripheral groove therein disposed on the opposite side of said second and third terminal posts from said first terminal post in position to engage the wire in said groove and said first terminal post having a groove thereabout in which said wire is disposed.

5. An improved miniature switch comprising:

an insulating base plate, a first terminal post mounted on top of said base at a first end thereof and having a groove thereabout, a captive post having a groove thereabout mounted on top of said base at a second end thereof, a second terminal post mounted on top of said base between said first terminal post and said captive post adjacent the latter and forwardly of the base from a line between said first terminal post and captive post, a preformed spring wire curved about said first terminal post and resiliently compressed between said second terminal post and an upright on said base toward the rear thereof with a wire end extending into the groove in said captive post, and a third terminal post mounted on top of said base slightly rearwardly of said base from said second terminal post on the opposite side of the wire from said second terminal post whereby application of a force to the wire rearwardly of the base between said first and second terminal posts actuates the switch to resiliently deflect the wire into engagement with the third terminal post and out of engagement with the second terminal post.

6. The switch of claim 5 further defined by said terminal posts each having a portion extending through said base to form depending prongs for attachment of the switch to another element.

7. The switch of claim 5 further defined by said wire being formed of steel music wire having a first substantially straight leg extending between said first terminal post and said captive post, a central preformed curved portion extending about said first terminal post in the groove thereabout and a second leg extending at an angle to the end of the curved portion away from said first leg whereby resilient wire deflection between said upright and second terminal post locks said wire on said first terminal post.

8. The switch of claim 5 further defined by said terminal posts being formed of rhodium plated brass at least in the areas thereof contacted by said wire.

* * * * *